United States Patent [19]

Watazychyn

[11] Patent Number: 4,935,167

[45] Date of Patent: Jun. 19, 1990

[54] METHOD AND APPARATUS FOR TREATING RADIOACTIVE WASTE

[76] Inventor: James S. Watazychyn, P.O. Box 3473, Teca Cay, S.C. 29715

[21] Appl. No.: 215,373

[22] Filed: Jul. 5, 1988

[51] Int. Cl.[5] ..... G21F 9/12; G21F 9/24; G21F 9/16; G21F 9/08

[52] U.S. Cl. ..... 252/633; 110/237; 110/238; 110/342; 110/345; 250/506.1; 252/628; 252/632

[58] Field of Search ..... 252/632, 633, 631, 506.1, 252/507.1; 110/165 R, 237, 238, 342, 345

[56] References Cited

U.S. PATENT DOCUMENTS

| | | | |
|---|---|---|---|
| 3,922,974 | 12/1975 | Hempelmann | 252/632 |
| 4,053,432 | 10/1977 | Tiepel et al. | 252/632 |
| 4,526,712 | 7/1985 | Hirano et al. | 252/632 |
| 4,555,361 | 11/1985 | Buckley et al. | 252/632 |
| 4,569,787 | 2/1986 | Horiuchi et al. | 252/632 |
| 4,586,981 | 5/1986 | Golubev et al. | 159/47.1 |
| 4,668,435 | 5/1987 | Grantham | 252/632 |
| 4,710,318 | 12/1987 | Horiuchi et al. | 252/628 |
| 4,793,831 | 12/1988 | Dirks et al. | 55/20 |
| 4,800,042 | 1/1989 | Kurumada et al. | 252/628 |

*Primary Examiner*—Howard J. Locker
*Attorney, Agent, or Firm*—William J. Ruano

[57] ABSTRACT

A process and apparatus whereby radioactive waste can be treated such as produced from within a nuclear power plant comprising the steps whereby waste is admitted to a dual 90 degree conveyor system, the latter of which transfers waste to an incinerator, burns the waste to ashes, transfers via vacuum the ashes for compaction, filters the exhaust particulate prior to dispensation to the atmosphere and provides a curie content accounting of each package.

3 Claims, 3 Drawing Sheets

METHOD AND APPARATUS FOR TREATING RADIOACTIVE WASTE

This invention relates to an apparatus and method whereby radioactive waste can be treated such as produced from within a nuclear power plant.

BACKGROUND OF THE INVENTION

Treatment of radioactive waste has been perplexing problem, particularly in the formation of a safe and easily handled and disposed end product as the result of the method of treatment of the waste.

SUMMARY OF THE INVENTION

This invention relates to a process to greatly reduce and greatly condense any combustible material such as produced from within a nuclear power plant that when incinerated the resultant ash having been reduced in volume by 90 percent is packaged using a suitable Type A container to apply compaction of the ash dispensed within. The latter step increases the volume reduction treatment by an additional 30 percent.

Nuclear waste materials require various controls and treatments dependent upon the type of waste. Contamination controls, packaging, and compaction within packaging are basic preparations prior to storage and subsequent shipping for burial. An additional requirement is to determine the total amount of curie content of the radioactive waste shipment. Sophisticated instrumentation can be incorporated to define the curie content of radioactive material substances. Simplifying the curie content determination using very accurate instrumentation reduces error.

DESCRIPTION OF THE PREFERRED EMBODIMENT

Figure 1:
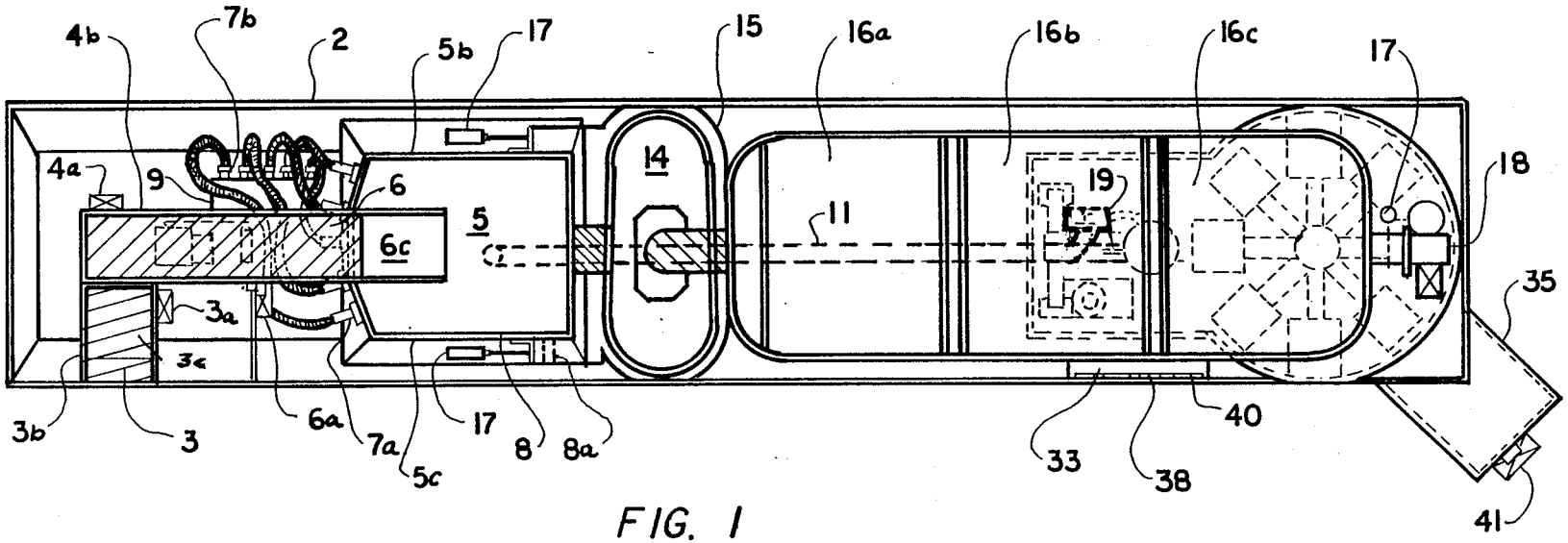
FIG. 1 is a top view of the apparatus for treating radioactive waste according to the method of the invention.

The "Radwaste" reduction unit is designed for fitted placement upon the surface of a lowboy trailer 1. The accompaniment will allow for the unit to be mobile. The use of a lowboy trailer 1 will lower the center of gravity reducing the chance of toppling. The low placement and design of the containment shield 2 will allow easy accessibility beneath bridges and reduce the coefficient of wind resistance during travel.

The unit is enclosed inside a trapezoid shape containment 2 serving two purposes. The enclosure 2 serves to contain any system leaks and provides some structural support. Product metals for consideration include any of the range of light weight high tensile strength metals.

All combustible waste materials are passed into the system via the front port charging chute 3. The charging chute consists of a primary inclined studded conveyor 3*c*. the primary conveyor 3*c* is upwardly aligned at 90 degrees to a secondary conveyor 4. Each conveyor system is power driven using an electrical motor

3*a* and 4*a*. Both conveyor systems are mounted and contained within two feet square steel corridors 3*b* and 4*b*. The secondary conveyor corridor 4*b* extends onto the top of the incineration chamber 5. Two and one half feet of drop space 6*c* is designed to allow for adequate flow of waste material into the incineration chamber 5. The drop space 6*c* is controlled in accessibility using a door 6 which slides forward and reverse motion. An electric motor 6*a* assembly having a gear attachment 6*b* to the shaft meshes with notched guide rods 6*d* traversing beneath the secondary conveyor 4 path. The position of the door 6 can then be remotely controlled. The containing of combustion gases during incineration keeps the direction for filtering and further treatment possible.

The actual chamber 5 comprises a rectangular volume arrangement divided into two sections. The uppermost section comprises the actual area for incineration. The interior comprises a pyrex shell 5*a* supported by a stainless steel framework. The structure is shrouded with ceramic fire brick 5*b* as a heat shield. Stainless steel plating 5*c* encases the entire structure. Between the fire brick and the stainless steel plating an air space is created to reduce heat transfer. A burning system 7 consisting of five plasma torches 7*a* (FIG. 1) is located at the front of the chamber 5 at a grate level 8. A liquid fuel reservoir 9 located in front of the chamber 5 beneath the secondary conveyor charging chute 4*b* provides the propane or acetylene gas as the incendiary fuel for burning. Control valves 7*b* (FIG. 1) are located outside the reservoir. The torches 7*a* are ignited using an electrical starter device 7*c* (FIG. 3) located inside the chamber 5 beneath each plasma torch 7*a*. The outside of the chamber 5 is draped with lead blankets 10 (FIG. 3) to form a barrier for radiation shielding. The barrier 10 provides a tenth-shielding factor from the material radiation dose inside compared to the material dose of radiation outside.

Incineration of polyethylene in the combustion process forms acids. These acids become corrosive to the system itself. Due to the origin of these acids in the incineration chamber the chemical balancing of the pH level toward more neutral levels is accomplished using pressurized injection tanks filled with base pH level powder and located beneath the secondary conveyor 4. The injection nozzle 43 from the base pH level tank 44 is connected to to incineration chamber from the charging chute side of the chamber. As the waste material is loaded into the chamber 5 base pH level, the range of which is 9 to 11, is injected and sprayed at the waste. During the combustion process the maintenance of the pH neutrality between the acids formed and the injected bases will be achieved. Another advantage of the pH balancing will increase the lifetime of the incineration system.

The lower section of the chamber is located beneath the grate level 8 separating where waste is burned and stored temporarily. The shape of the lower section resembles a trapezoid. Metal plating 5*c* used in the upper construction is used in the lower construction as well. The lower section serves both as a base structural support and a primary storage containment for capturing ash material. A lead shield barrier 10 surrounds the lower section. Varying the amounts of tenth-shielding factors will invariably reduce the radiation dose rates much more exponentially. Another feature of the lower section of the chamber is an attached pipe 11 where upon a vacuum is induced to transfer ash material to be compacted and packaged. The location of the transfer pipe 11 is at the back center of the chamber 5. The base of the lower section contains plates 12 FIG. 3 which taper so as the collection of ash is drawn to a low functional point. The point at which the ash material falls upon itself is the point at which the pipe for ash transfer is located.

All exhaust gases produced in the incineration process are emitted from the chamber 5 and pass through a cooler 14. The design of the cooler 14 has a primary and secondary side. An enclosure of tubing 14a surrounded by an outer shell restrict the combustion gases to pass within. The secondary side of the tubing 14a forming a containment barrier is an encapsulation for containing a liquid coolant such as nitrogen. Surrounding the shell is an insulation barrier 15.

All cooled combustion gases pass into a filter containment 16. Two mediums of decreasing mesh sizes of activated charcoal are provided for the effluent to pass within to reduce the particulate concentration down to 20 microns. Thereafter, the particulate concentration is reduced by 99.97 percent through three phases of HEPA filters. The effluent is then exhausted to the atmosphere. A gas monitor provides periodic analysis of emmitted effluent for isotopic identification. The two activated charcoal mediums 16a and 16b as well as the HEPA filter phases 16c are illustrated in FIG. 3.

Figure 3:
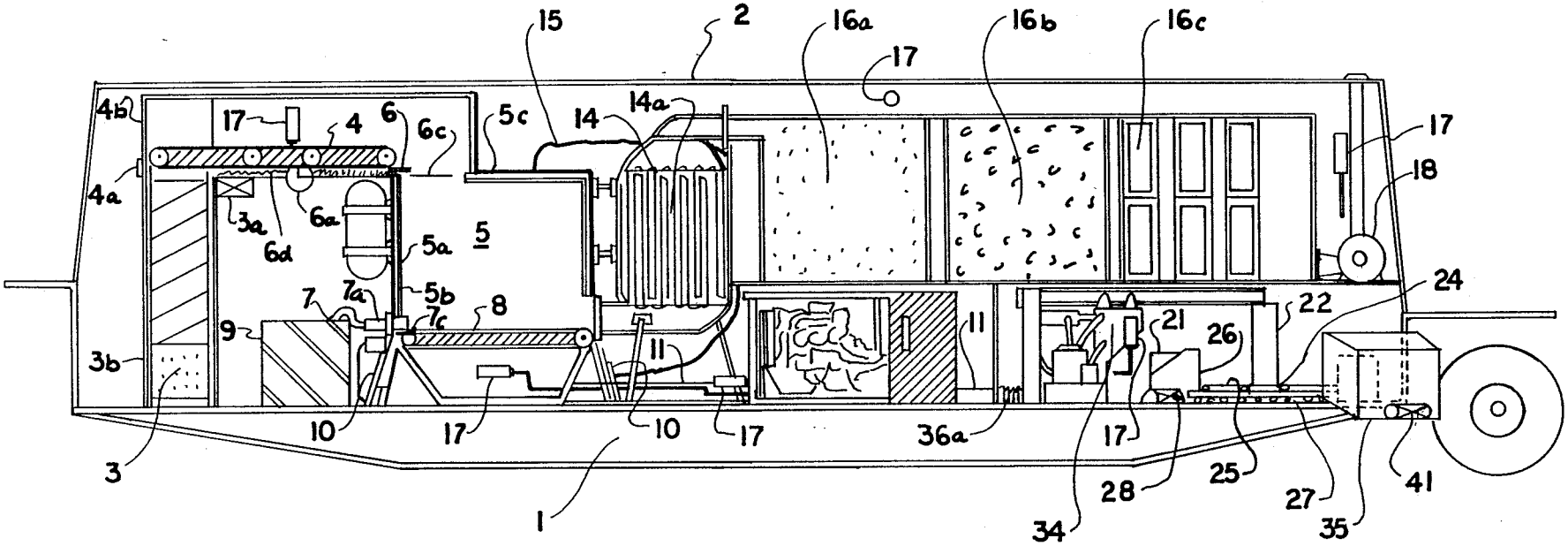
FIG. 3 is a side view of the apparatus for treating radioactive waste according to the method of the invention.

In the preferred embodiment for ash transferring, a blower motor 18 FIG. 3 is set up to provide the draft and negative pressure to draw the combustion gases through the cooler 14, the two activated charcoal bins 16a and 16b, and finally the three phases of HEPA filter banks depicted in 16c.

Figure 4:
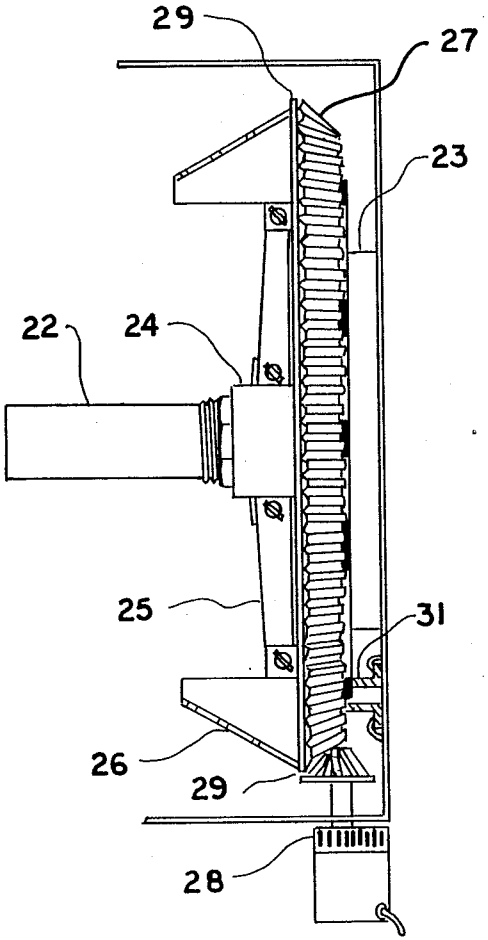
FIG. 4 is an enlarged view of the drive for the package assembly shown at the lower right of FIG. 3.

The transfer pipe 11 connected to the base of the incineration chamber 5 containment is a straight pipe which extends to the rear of the system 1 to another blower motor 19. At the rear of the unit 1 the ash is loaded into a container 21 positioned in the package compartment 20, FIG. 2. The package assembly comprises a center axle 22 mounted to the base of the trailer 1. A bearing 23 FIG. 3 set at the base of the axle 22 supports a hub 24. Protruding from the hub 24 are eight spokes 25 arranged at 45 degree angles. At the ends of the spokes 25 are support boxes hereinafter called retainer trays. A circular metal plate 29 forming a turntable platform for the package compartment 20 is fitted onto the bearing 23 over the center axle 22. The hub 24 is threaded down onto the center axle slipping through and atop of the circular plate. A beveled gear 27 is welded beneath the turntable for which the assembly 20 can be controlled in forward or reverse movement interfacing with motor and meshable small gear. FIG. 4 depicts the motor 28 and gear drive assembly. The interior and the exterior circles of the circular plate ride upon bearings (see FIG. 4). The turntable turns counterclockwise. Limit switches 31 are attached to the underside of each retaining tray 26 at a center point. Every turn of 45 degrees connects the position of the brushes providing a lighted signal at the remote control panel 33 FIG. 1. The light signals that the retaining tray is in position. Should the light go off, the motor 28 can be remotely operated in reverse or forward operation to align the assembly with the compactor ram assembly 34.

Figure 2:
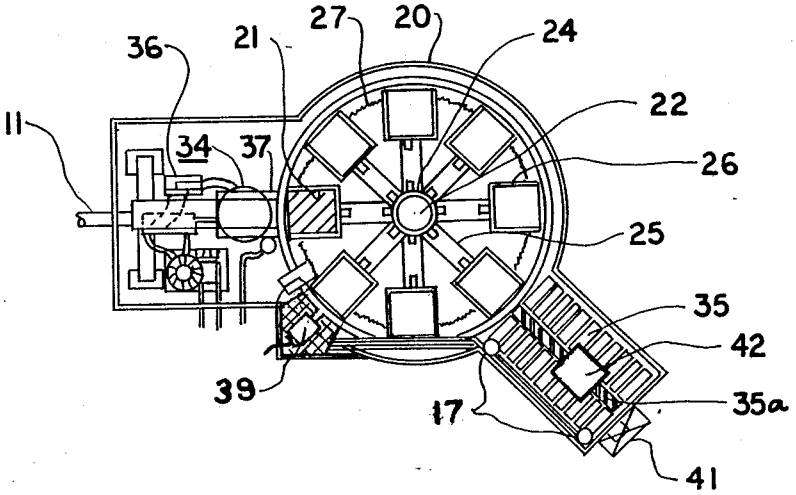
FIG. 2 is a top view of the package compartment 20 and associated parts hidden at the right of FIG. 1.

In the preferred embodiment, the assembly comprising the hydraulic equipment and two rams form the compactor assembly 34, FIG. 2. A solenoid switch arrangement provides remote operation of the compactor assembly 34. In one motion the smaller ram moves the compactor ram assembly 34 over the positioned retainer tray 26 interlocking for a tight fit. The glove box 35 showing the rollers arrangement in the preferred embodiment is provided as a chamber through which metal containers 21 are passed. The size of the metal container 21 preferred is 14 inches wide by 12 inches high by 16 inches long.

One feature of the compactor assembly 34 is the attachment of flexible hose 36a from a blower motor 36 creating vacuum to transfer ash material from the bottom section of the incineration chamber 5. The blower motor 36 in the preferred embodiment of the invention is mounted in line with the ash transfer pipe 11 in front of the point at which the compactor assembly 34 travels most forward. The flexible hose 36a is fitted from the blower 36 to the side casing of the compactor ram 34. Affixed to the bottom of the compacting ram 34 is a square metal plate 37 having slotted guides to interlock with the top section of the retainer trays 26. The interlocking in the assembly prevents movement during ash transfer to a container 21. A temporary containment is formed between compactor 34 and retainer tray 26 during filling of ash material into the receiving metal box 21 loaded onto the retainer tray 26. (The compactor ram is freely capable of pushing down ash material and retracting to its upright position beneath the attached fitted square metal plate at the base of the compactor ram casing.) The flexible hose 36a attached to the ram casing is inserted through the metal plate 37 the end of which is fashioned into the containers 21 and the radioactive material is compacted. An intermittent operation must ensue to fill each container 21. Electronic equipment is available today to purchase with compactor equipment and signal when compaction is complete. The operations panel 33 added with such a feature signals the operator to advance the next retaining tray 26. Counting equipment is available to determine the number of loads have been compacted. A cycle is completed after eight containers 21 have been filled.

A feature of the preferred embodiment located in part at the operations panel 33 is radioactive material counting equipment for determination of the curie content in each filled compacted container 21 of waste. The particular equipment is known as a multichannel analyzer 38, a germanium-lithium detector 39, and a data printer 40 (FIGS. 1, 2). The calculation of total curies of waste material, type of waste material is important information recorded by nuclear power plants and waste receiving stations.

Waste containers 21 are removed from the package unit 20 in the opposite manner in which the containers 21 are loaded. In the FIG. 2 of the preferred embodiment, a motor 41 located at the exterior end of the glovebox 35 is a forward reversible type connected to a worm gear shaft 35a upon which is driven a metal plate 42. Loading and unloading of containers 21 are accomplished as such and also functions as a distance factor to keep operations personnel from getting exposed to large doses of radiation that may build up during the compacting operation. The chamber also serves as an enclosed containment where each container 21 is capped after compacting waste material. A radiation detector 17 is provided in the chamber 35 to provide the surface radiation dose rate on a filled waste container 21.

The entire system for the radioactive waste volume reduction apparatus is independently powered using an electrical generating motor 45 (FIG. 3).

Thus it will be seen that I have provided a novel and highly efficient apparatus and method for treating radioactive waste safely.

While I have illustrated and described a single specific embodiment of my invention, it will be understood that this is by way of illustration only and that various changes and modifications may be contemplated in my invention within the scope of the following claims.

I claim:

1. A method of safely treating and reducing combustible radioactive waste volume before burial comprising the following steps:

encasing an apparatus within a metallic shield;

transferring radioactive waste by conveyor means through said shield;

conveying said waste to the top and into an incineration chamber in said apparatus;

adding caustic powder to said waste;

incinerating said waste in said chamber;

collecting resulting ash in a vessel below said incineration chamber;

said chamber and said vessel being surrounded with a lead shield;

transferring said waste ash to a compacting chamber;

cooling said exhaust gases from incineration;

filtering said cooled exhaust gases;

compacting said waste ash within a container;

and discharging compacted ash from said first metallic shield.

2. The method as defined in claim 1 further comprising mounting said first metallic shield on a lowboy trailer to lower the center of gravity of said apparatus when moving said apparatus.

3. A method for remotely handling and treating radioactive waste by disposing it into packages that will safely hold the contents therein when handled, the following steps comprising the method:

initially transferring the waste by conveyor belt means to a grated furnace located within an enclosed metallic chamber, incinerating the waste to 1500° F. in the grated furnace, cooling combustion gases from incineration through a heat exchanger, neutralizing the resulting corrosive acid gases with an alkaline crystal bed, capturing the resultant salt and resultant water byproducts of said neutralization, disposing of water from said neutralization within the furnace, capturing and filtering the remaining radioactive waste particulates in the effluent gases by passing said effluent gases in series to two composite meshes of activated charcoal cells and three phases of HEPA filters, exhausting the resulting filtered gas to the air, transferring the ash waste resulting from said incineration to a collection bin beneath the incineration chamber, and from said collection bin transferring said ash waste into a metallic container using vacuum, compacting by hydraulic means the ash filled in the container to form a package, counting the radioactive curie content of the compacted ash waste using a detector placed near the side of the package, and interfacing the detector with a multichannel analyzer.

* * * * *